US010835009B2

(12) United States Patent
Brownsell et al.

(10) Patent No.: US 10,835,009 B2
(45) Date of Patent: Nov. 17, 2020

(54) HAIR TAPESTRY WEAVING TOOL

(71) Applicant: Hairmoji Limited, Rotherham (GB)

(72) Inventors: Alexandra Brownsell, London (GB); Stefan Knox, Haslemere (GB); Kirstin Knox, Haslemere (GB); Sarah Cheatham, Haslemere (GB)

(73) Assignee: Hairmoji Limited, Rotherham (GB)

( * ) Notice: Subject to any disclaimer, the term of this patent is extended or adjusted under 35 U.S.C. 154(b) by 267 days.

(21) Appl. No.: 15/908,684

(22) Filed: Feb. 28, 2018

(65) Prior Publication Data

US 2018/0242670 A1 Aug. 30, 2018

(30) Foreign Application Priority Data

Feb. 28, 2017 (GB) ..... 1703202.0

(51) Int. Cl.

| | |
|---|---|
| ***A45D 24/06*** | (2006.01) |
| ***D03D 29/00*** | (2006.01) |
| ***A45D 1/18*** | (2006.01) |
| ***D03D 41/00*** | (2006.01) |
| ***A45D 24/04*** | (2006.01) |
| ***A45D 1/06*** | (2006.01) |
| ***A45D 2/00*** | (2006.01) |
| ***A45D 8/00*** | (2006.01) |

(52) U.S. Cl.

CPC ..... *A45D 24/06* (2013.01); *A45D 1/06* (2013.01); *A45D 1/18* (2013.01); *A45D 2/002* (2013.01); *A45D 8/00* (2013.01); *A45D 24/04* (2013.01); *D03D 29/00* (2013.01); *D03D 41/001* (2013.01)

(58) Field of Classification Search

CPC ... A61Q 5/00; A45D 1/06; A45D 8/02; A45D 1/18; A45D 2/002; A45D 8/00; A45D 24/04; A45D 24/06; D01B 9/00; D03D 29/00; D03D 41/001

See application file for complete search history.

(56) References Cited

U.S. PATENT DOCUMENTS

| | | | | | |
|---|---|---|---|---|---|
| 952,491 | A * | 3/1910 | Youngs | A45D 24/02 | 132/159 |
| 1,595,595 | A * | 8/1926 | Bonat | A45D 8/12 | 132/105 |
| 1,975,924 | A * | 10/1934 | Collingbourne | D03D 29/00 | 28/151 |

(Continued)

FOREIGN PATENT DOCUMENTS

| | | |
|---|---|---|
| CN | 201977005 | 9/2011 |
| JP | 60-179205 | 11/1985 |

(Continued)

*Primary Examiner* — Robert H Muromoto, Jr.
(74) *Attorney, Agent, or Firm* — Levy & Grandinetti

(57) ABSTRACT

A weaving tool has a first part and a second part, in which a first end of the first part is connected to a first end of the second part by a hinge. The first part has a first comb portion with first teeth extending away from the hinge, and the second part comprises a second comb portion with second teeth extending away from the hinge. The first part and the second part are movable about an axis of the hinge between a first position in which the first comb portion and the second comb portion are substantially parallel, and a second position in which the first comb portion and the second comb portion are displaced from one another about the axis.

14 Claims, 5 Drawing Sheets

(56) References Cited

U.S. PATENT DOCUMENTS 2,077,532 A * 4/1937 Rossiter ..... D03D 29/00 139/33
3,054,277 A * 9/1962 Broschard ..... D04B 3/00 66/1 A
3,724,041 A * 4/1973 Cleverley ..... D04D 11/00 28/149
4,013,086 A * 3/1977 Chmela ..... A45D 24/10 132/110
4,077,436 A * 3/1978 Kliot ..... D03D 29/00 139/34
4,414,992 A * 11/1983 Russell ..... A45D 2/00 132/129
D293,489 S * 12/1987 Franzino ..... D28/25
5,365,952 A 11/1994 Noble et al.
5,865,190 A * 2/1999 Butler ..... A45D 8/20 132/208
5,988,184 A * 11/1999 Shu ..... A45D 8/20 132/129
6,019,108 A * 2/2000 Chen ..... A45D 8/20 132/273
6,206,011 B1 * 3/2001 Sartena ..... A41G 5/00 132/201
6,273,097 B1 * 8/2001 Sartena ..... A41G 5/00 132/275
6,446,639 B1 * 9/2002 Shyu ..... A45D 8/20 132/275
D483,151 S * 12/2003 Walker ..... D28/40
6,834,682 B2 * 12/2004 Jenner ..... D03D 29/00 139/29
10,219,602 B2 * 3/2019 Purkey ..... A45D 8/38
2002/0153050 A1 * 10/2002 Jenner ..... D03D 29/00 139/29
2014/0366908 A1 12/2014 Shevlin
2015/0296953 A1 * 10/2015 Murdock ..... A61K 8/25 132/203

FOREIGN PATENT DOCUMENTS

JP 5-51203 7/1993
JP 2004-357740 12/2004
KR 1020120035627 4/2012

* cited by examiner

HAIR TAPESTRY WEAVING TOOL

The present invention relates to a weaving tool, for use particularly, but not exclusively, by children and young people to create hair tapestries.

Hair tapestries are fashionable hair decorations formed by weaving threads of material into strands of a subject's hair. Various patterns can be created by using different threads of material, and by weaving that material in different ways. In order to create a hair tapestry it is necessary to form the subject's hair into stable warp strands, between which the threads of decorative material can be woven as weft strands. This can be done using a pair of combs or similar structures, one of which is placed at one point in a subject's hair, and the other of which is placed at another point lower down. The warp strands are thereby formed between opposed teeth of the two combs, and are easy to weave between because they are held laterally apart from one another. However, this technique can be difficult to perform efficiently, because the two combs have to be secure in the subject's hair, and a tension between then has to be manually maintained.

Another method involves using a frame with spaced apart clamps, which is placed in a subject's hair with a portion thereof held securely between the spaced apart clamps. The user then uses a comb to separate the captured hair into warp strands inside the frame. This approach addresses the issue of holding the warp strands under tension, but it suffers from the drawback that the warp strands are very close to one another because their ends are clumped together under the clamps, and it is therefore difficult to weave between them. It usually requires one hand to weave and the other to manipulate the warp strands apart from one another. Another issue is the use of a secure clamping device, which may not be suitable for children or young people as it could cause an injury if misused.

The present invention is intended to overcome some of the above described problems.

Therefore, according to the present invention a weaving tool comprises a first part and a second part, in which a first end of said first part is connected to a first end of said second part by a hinge, in which said first part comprises a first comb portion with first teeth extending away from said hinge, and in which said second part comprises a second comb portion with second teeth extending away from said hinge, in which said first part and said second part are movable about an axis of said hinge between a first position in which said first comb portion and said second comb portion are substantially parallel, and a second position in which said first comb portion and said second comb portion are displaced from one another about said axis.

Thus, the present invention provides a collapsible loom like device in which the two parts of the warp strand frame thereof are made up of comb portions which can be arranged parallel to one another for transportation or storage, and then rotated apart from one another so as to create a warp strand area for weaving. Such a structure overcomes the issues with prior art frames because no clamping of the hair is required, and the warp strands are held laterally apart from one another making it easier to weave between them.

It will be appreciated that the present invention could be used to weave any materials, but it finds particular application for weaving hair tapestries, in which the warp strands are made up of a subject's hair, and the weft strands are made up of chosen decorative materials.

In a preferred construction the hinge can comprise a stop mechanism which delimits rotation of the second part about the hinge beyond the second position. In the second position the first comb portion and the second comb portion can be substantially normal to one another. Thus, the warp strand area can be at substantially 45 degrees to the first part and the second part in the second position. This provides the maximum amount of space in which to perform the weaving action by hand. A greater angle between the first part and the second part reduces the space underneath the warp strands, and a lesser angle reduces the weavable area.

One issue which needs to be addressed to maximise the utility of the weaving tool is the retention of the warp strands between the first comb portion and the second comb portion. If the warp strands are not held at a sufficient tension then weaving becomes difficult. This can be achieved by having small or tapering gaps between the first teeth of the first comb portion and between the second teeth of the second comb portion and/or by providing the first teeth and the second teeth with a resilience such that they can be placed under extension when strands of hair are placed between them, thereby to retain the strands of hair.

However, in a preferred construction the first comb portion can comprise first blocks of resilient material in gaps between the first teeth, which first blocks of resilient material can comprise cuts for receiving strands of warp material to be woven with which the tool is used. Likewise, the second comb portion can comprise second blocks of resilient material in gaps between the second teeth, which second blocks of resilient material can comprise cuts for receiving strands of warp material to be woven with which the tool is used.

These blocks of resilient material can be constructed from a resilient foam material which can readily retain strands of hair under tension in the cuts formed therein. As such, the first comb portion and the second comb portion comprise the first teeth and the second teeth respectively which can be used to first gather the subject's hair into warp strands by means of combing through it, and then the first blocks of resilient material and second blocks of resilient material respectively which can be used to retain those strands by manually manipulating the subject's hair into the cuts therein.

The hinge can be any known hinge mechanism. However in a preferred construction the hinge can comprise a pair of slots on the first part which are aligned with the axis and face outwardly from a centre point thereof in opposite directions, and a pair of arms on the second part, each of which faces towards the centre point and is disposed in one of the slots. This is a simple and expedient construction which can be readily manufactured, in particular if the first part and the second part are constructed from resilient plastics materials to such an extent that they can be flexed sufficiently for the arms to be manually placable in the slots. As such, no additional constructional components are required.

The slots can be formed in first side walls of the first part, and the second part can comprise second side walls overlaying the first side walls, from inside surfaces of which the arms can extend.

The first part can be constructed in any known way, provided it comprises the above described technical features. However, in a preferred embodiment the first part can comprise a first outer member and a first inner member connected together. The first comb portion can comprise a first outer comb portion provided on the first outer member and a first inner comb portion provided on the first inner member. The first outer comb portion can then comprise a first outer recess on an inner side thereof, and the first blocks of resilient material can be disposed between the first outer member and the first inner member in a compartment formed by the first outer recess. This construction allows for the first blocks of material to be firmly held in place between the first teeth. It also allows for manufacturing efficiencies, for example the first pair of slots can be formed by recesses formed in the first outer member and the first inner member which align to form the slots.

The second part can be constructed in a likewise manner. As such, the second part can comprise a second outer member and a second inner member connected together. The second comb portion can comprise a second outer comb portion provided on the second outer member and a second inner comb portion provided on the second inner member. The second inner comb portion can then comprise a second inner recess on an outer side thereof, and the second blocks of resilient material can be disposed between the second outer member and the second inner member in a compartment formed by the second inner recess. Once again, this allows for the second blocks of material to be held in place, and for certain manufacturing efficiencies to be made.

Preferably the tool can comprise a third part, an inner side of which can be releasably connected to an outer side of the first part. The third part can comprise a third comb portion with teeth extending away from the hinge. The third part is basically just a comb, which can be used to assist the weaving process, as described further below. It can be released from the first part for use when needed, and stored thereon when not.

In this description the terms "inner" and "outer" are used to orient parts or surfaces in relation to the area between the first part and the second part, which becomes the weaving area in use. Therefore, the first inner member and second inner member face one another, and the first outer member and second outer member are on the outside of the tool.

The tool of the present invention can be used by anyone to weave hair tapestries. However, as described above, the weaving of hair tapestries is a trend which currently appeals to children and young people. The tool of the present invention can therefore be aimed at such users, and it can comprise technical features which facilitate that. Namely, an inner side of the first part can comprise a stylized face comprising a mouth aperture and two eye formations. As such, the tool of the present invention can have the appearance of a stylized character, in which the facial features are made up of the mouth aperture and the two eye formations, and a hair feature is made from the first comb portion.

In a preferred construction each of the eye formations can comprise an annular socket provided with an annular protrusion extending from a base thereof. With this construction the eye formations have the appearance of eye balls with pupils. This allows for expressive eye features which have the appearance of eyes looking in a particular direction, or simply being more expressive than two circles. In particular, in a preferred construction a distance between centers of the annular protrusions can be less than a distance between centers of the annular sockets, which gives the face a forward staring expression. This is even more so if the centers of the annular protrusions are slightly above the centers of the annular sockets. This is explained in more detail below in relation to the Figures.

The mouth aperture can be any shape which creates an expression, such as a smile or frown. However, preferably the mouth aperture can comprise a complex shape with teeth abutments extending from an outer periphery thereof towards a centre point thereof. As such, the mouth can have the appearance of that of a roaring animal or monster.

Following on from this the second part can comprise a recess formed in the first end thereof, which recess exposes the mouth aperture in the first position, and two eye apertures which can overlay the eye formations in the first positon. These features ensure that the stylized face remains when the tool is in the first position.

In a preferred embodiment the first part can comprise a foot part releasably connected to the first end thereof. The foot part can allow the tool to be stood upright for storage. It can also add another feature to the characterization of the tool, by forming feet or shoes of the stylized character.

The first comb portion and the second comb portion can be substantially planar, but in a preferred construction they can be curved in a first plane, which first plane is parallel to a second plane in which the axis extends. This provides a more ergonomic shape for use.

The present invention can be performed in various ways, but one embodiment will now be described by way of example, and with reference to the accompanying drawings in which.

Figure 1:
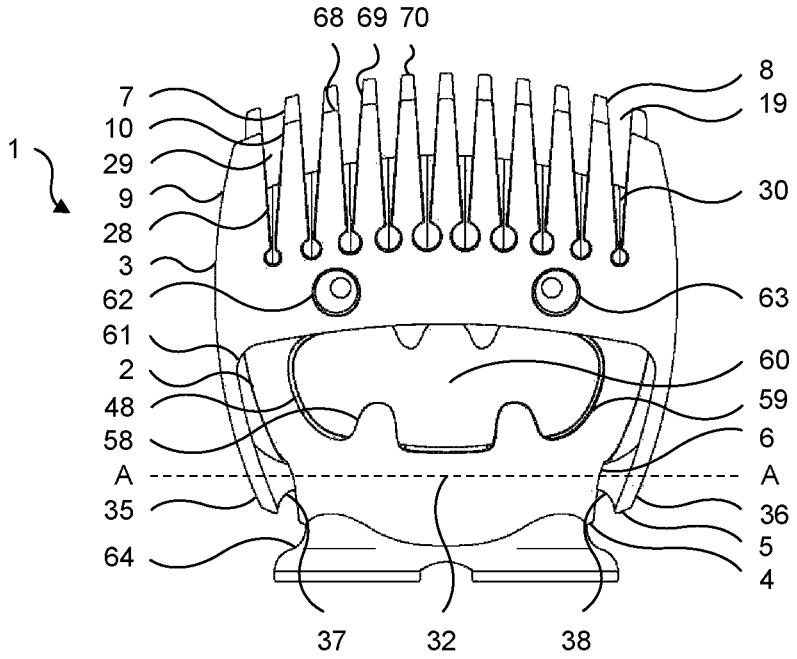
FIG. 1 is a front view of a weaving tool according to the present invention in a first position.
Figure 4:
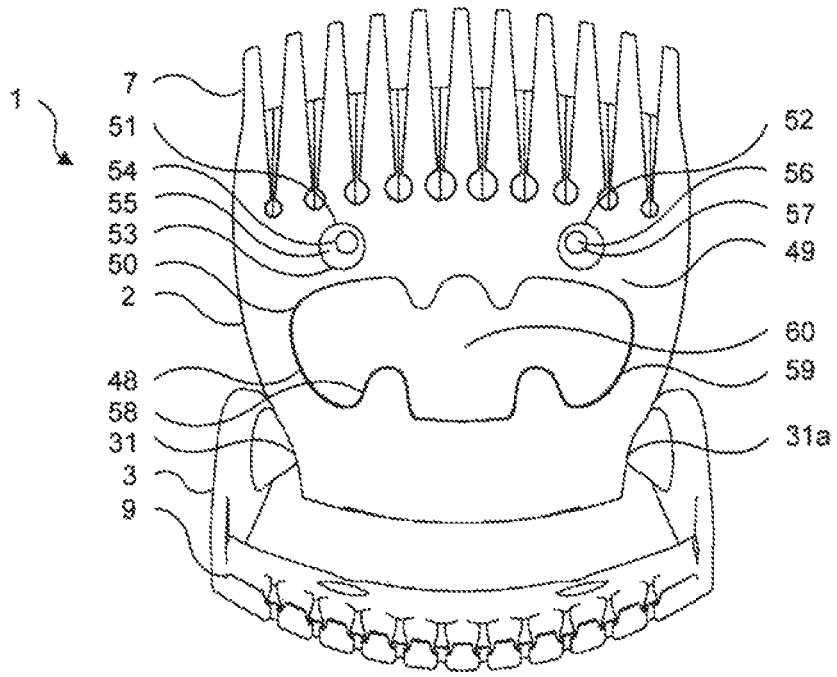
FIG. 4 is a front view of the weaving tool as shown in FIG. 1 in a second position.
Figure 5:
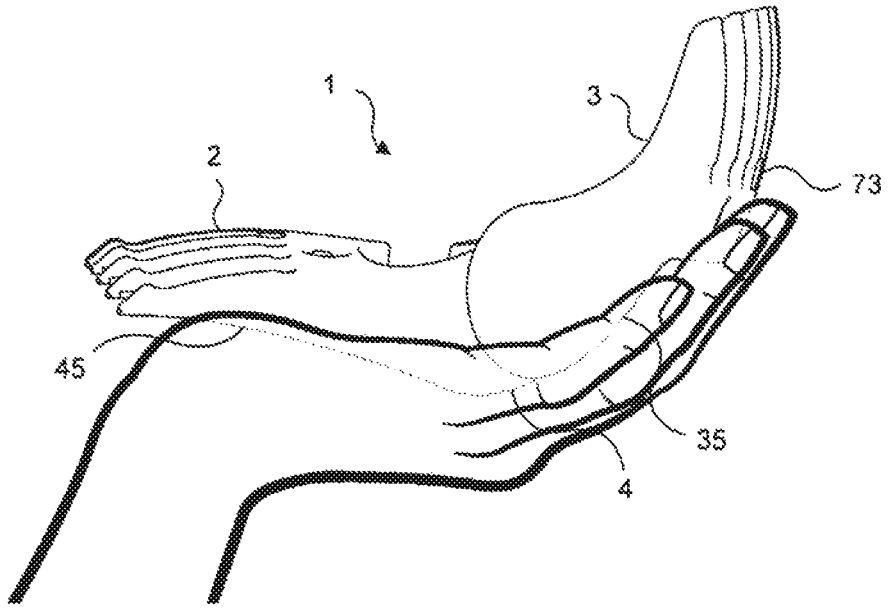
FIG. 5 is a side view of the weaving tool as shown in FIG. 1 in a second position in a user's hand.
Figure 6:
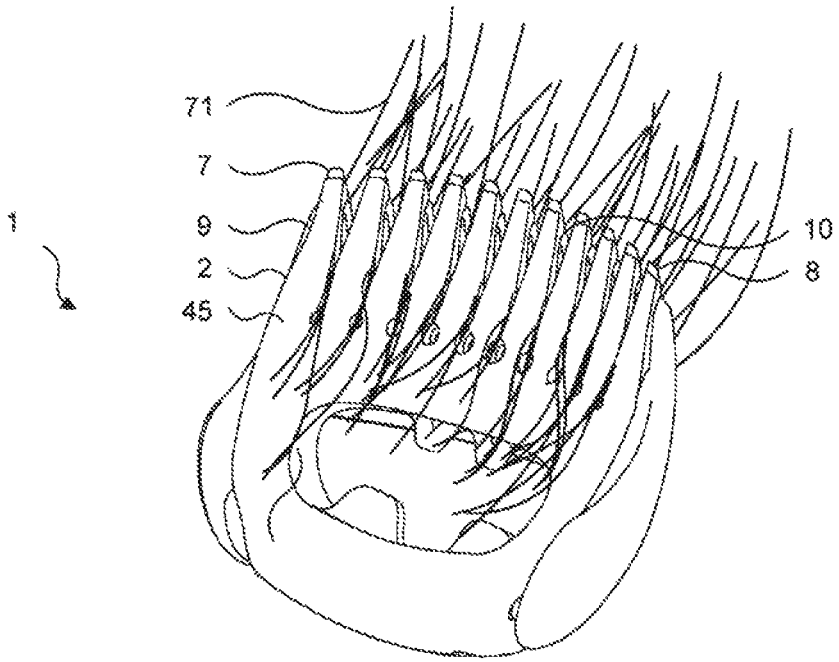
FIG. 6 is a perspective view of the weaving tool as shown in FIG. 1 in use in a first position.

As shown in the Figures, a weaving tool 1 comprises a first part 2 and a second part 3, and a first end 4 of the first part 2 is connected to a first end 5 of the second part 3 by a hinge 6. The first part 2 comprises a first comb portion 7 with first teeth 8 extending away from the hinge 6, and the second part 3 comprises a second comb portion 9 with second teeth 10 extending away from the hinge 6. First teeth 8 have a base part **8*a* thereof proximal to the hinge axis and an end tip part 70 thereof distal to the hinge axis. Second teeth 10 have a base part 10*a* thereof proximal to the hinge axis and an end tip part 68 thereof distal to the hinge axis. As explained further below, the first part 2 and the second part 3 are movable about an axis A-A of the hinge 6 between a first position, as shown in FIGS. 1 and 6, in which the first comb portion 7 and the second comb portion 9 are substantially parallel, and a second position, as shown in FIGS. 2-5 and 7-10 in which the first comb portion 7 and the second comb portion 9** are displaced from one another about the axis A-A.

Figure 2:
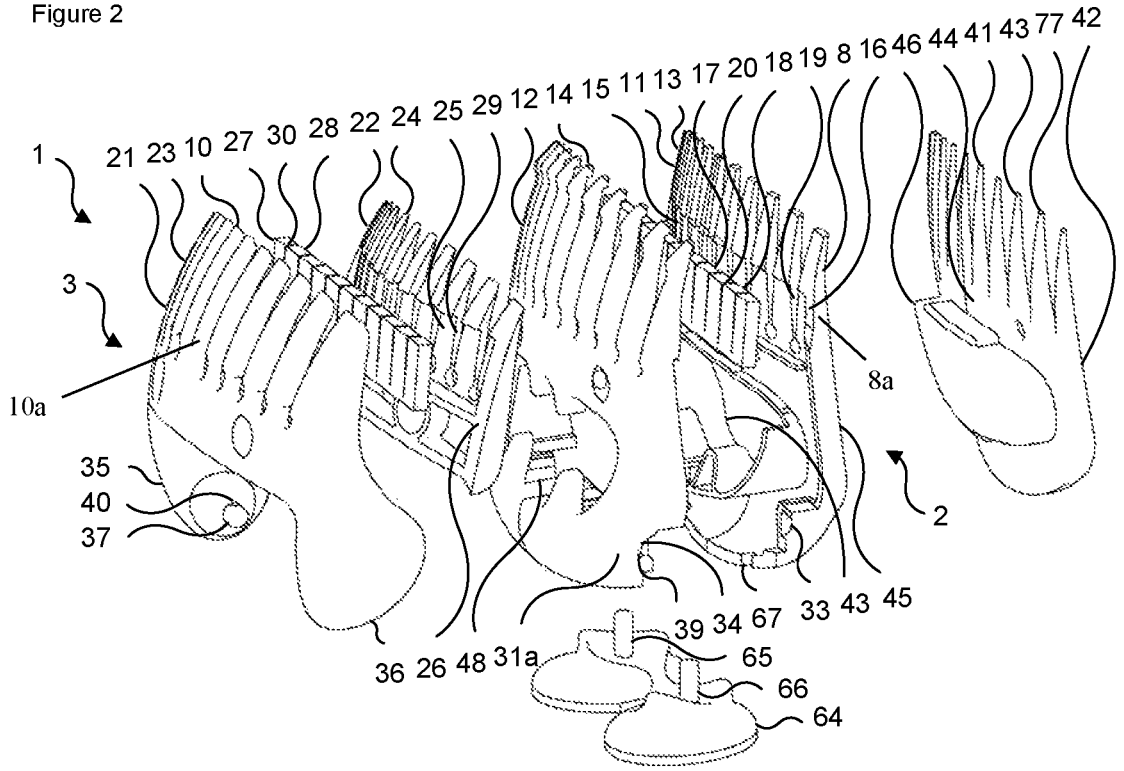
FIG. 2 is an exploded perspective view of the weaving tool as shown in FIG. 1.

As shown in FIG. 2, the tool 1 is constructed from six molded plastics components. In particular, the first part 2 comprise a first outer member 11 and a first inner member 12 which are connected together in a snap-fit arrangement to form the complex three dimensional shape of the first part 2. The first comb portion 7 comprises a first outer comb portion 13 provided on the first outer member 11 and a first inner comb portion 14 provided on the first inner member 12.

These two comb portions 13 and 14 are connected together to form the first comb portion 7, with each of the first teeth 8 made up of a part of each.

The first outer comb portion 13 comprises a first outer recess 15 on an inner side 16 thereof, in which a first foam member 17 is disposed. It is held in place on the first outer recess 15 when the first outer member 11 and first inner member 12 are connected together.

As is clear from FIG. 2, the first outer comb portion 13 coincides with the first outer recess 15 such that the first foam member 17 is located between the first teeth 8. In this way the first foam member 17 forms first blocks of resilient material 18 located in first gaps 19 between the first teeth 8. The first foam member 17 comprises a row of first cuts 20 formed therein, each of which is located in the centre of one of the first gaps 19. In this way each of the first blocks of resilient material 18 comprises a first cut 20 for receiving warp strands of hair to be woven, as described further below.

The second part 3 is constructed in a likewise manner. Namely, it comprises a second outer member 21 and a second inner member 22 which are connected together in a snap-fit arrangement to form the complex three dimensional shape of the second part 3. The second comb portion 9 comprise a second outer comb portion 23 provided on the second outer member 21 and a second inner comb portion 24 provided on the second inner member 22. These two comb portions 23 and 24 are connected together to form the second comb portion 9, with each of the second teeth 10 made up of a part of each.

The second inner comb portion 24 comprises a second inner recess 25 on an outer side 26 thereof, in which a second foam member 27 is disposed. It is held in place in the second inner recess 25 when the second outer member 21 and the second inner member 22 are connected together.

As is clear from FIG. 2, the second inner comb portion 24 coincides with the second inner recess 25 such that the second foam member 27 is located between the second teeth 10. In this way the second foam member 27 forms second blocks of resilient material 28 located in second gaps 29 between the second teeth 10. The second foam member 27 comprises a row of second cuts 30 formed therein, each of which is located in the centre of one of the second gaps 29. In this way each of the second blocks of resilient material 28 comprises a second cut 30 for receiving warp strands of hair to be woven, as described further below.

The first part 2 comprises first side walls 31 and 31*a* in which are formed slots (not visible) which are aligned with the axis A-A and face outwardly from a center point 32 thereof in opposite directions. Each of the slots is formed by opposing recesses 33 and 34 formed in the first outer member 11 and first inner member 12 respectively. This is visible in FIG. 2, and the same arrangement is provided on the opposite side of the first part 2.

The second part 3 comprises second side walls 35 and 36, which overlay the first side walls 31 and 31*a* respectively. Extending from each second side wall 35 and 36 is an arm 37 and 38 respectively, each of which faces towards the center point 32 and is disposed in one of the slots (not visible) The slots and the arms 37 and 38 form the hinge 6.

Figure 3:
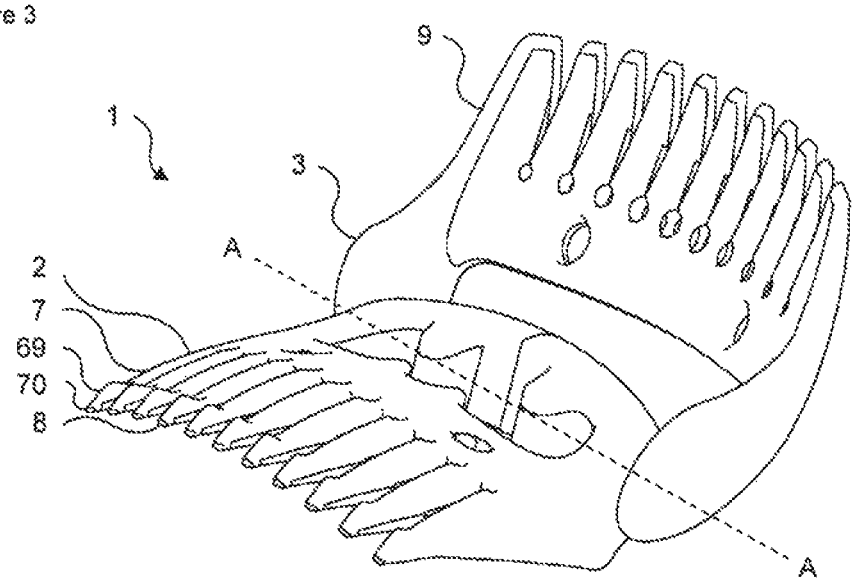
FIG. 3 is a perspective view of the weaving tool as shown in FIG. 1 in a second position.

Each of the recesses 34 on the first inner member 12 is provided with a radially inwardly extending surface 39. Each of the arms 37 and 38 is provided with a radially outwardly extending boss 40, visible in FIG. 2. As such, the second part 3 can only be rotated about the axis A-A until the bosses 40 comes into contact with the surfaces 39. This delimits rotation of the second part 3 beyond the second position. As shown in FIGS. 3 to 5, in the second position the first comb portion 7 and the second comb portion 9 are normal to one another.

The tool 1 comprises a third part 41, which is basically just a comb with a body part 42 and a third comb portion 43. An inner side 44 of the third part 41 is releasably connected to an outer side 45 of the first part 2. A protrusion 46 provided on the inner side 44 is a releasable friction fit in an outer side 47 of mouth aperture 48 formed in the first part 2. The third part 41 can be used to assist the weaving process, as described further below. It can be released from the first part 2 for use when needed, and stored thereon when not.

The tool 1 is intended to appeal to children and young people, and comprises an anthropomorphic aesthetic design. Namely, as shown in FIG. 4, an inner side 49 of the first part 2 comprises a stylized face 50 comprising the mouth aperture 48 and two eye formations 51 and 52. The first comb portion 7 then has the appearance of hair above the face 50.

Each of the eye formations 51 and 52 comprises an annular socket 53 provided with an annular protrusion 54 extending from a base 55 thereof. As is clear from FIG. 4, the distance between centers 56 of the annular protrusions 54 is less than a distance between centers 57 of the annular sockets 53, and the centers 56 of the annular protrusions 54 are slightly above the centers 57 of the annular sockets 53. With this arrangement the face 50 has a forward staring expression.

The mouth aperture 48 comprises teeth abutments 58 extending from an outer periphery 59 thereof towards a centre point 60 thereof. As is clear from FIG. 4 the mouth aperture 48 gives the face 50 a roaring or open-mouthed expression. In combination, the eye formations 51 and 52 and the mouth aperture 48 combine to create an amusing stylized monster character, which children or young people will find appealing.

Referring back to FIG. 1, the second part 3 comprises a recess 61 formed in the first end 5 thereof, which recess 61 exposes the mouth aperture 48 in the first position. Further, the second part 3 also comprises two eye apertures 62 and 63 which overlay the eye formations 51 and 52 in the first positon. These features ensure that the stylized face 50 remains when the tool 1 is in the first position. In addition, it may also create the impression that the stylized character is wearing a mask over their face, in particular if the first part 2 and the second part 3 are made in different colours. This adds to the amusing and appealing nature of the stylized character.

The first part 2 comprise a foot part 64 releasably connected to the first end 4 thereof. The foot part 2 allows the tool 1 to be stood upright for storage or presentation, as shown in FIG. 1. It also adds yet another feature to the anthropomorphic characterization of the tool 1, by giving the stylized character the appearance of having feet, or of wearing footwear. The foot part 64 comprises a pair of spigots 65 and 66, which are releasably placable in a pair of slots (not visible) which are formed in the first end 4 of the first part 2. In particular, pairs of opposed recesses, only one of which 67 is visible in FIG. 2, are provided on the first outer member 11 and first inner member 12, which combine to form the slots (not visible) when the first outer member 11 and the first inner member 12 are connected together.

As is clear from the Figures, the first comb portion 7 and the second comb portion 9 are curved in a first plane, which first plane is parallel to a second plane in which the axis A-A extends. This provides a more ergonomic shape for use. The third comb portion 43 has the same shape.

The first teeth 8 extend further from the hinge 6 than the second teeth 10. However, to ensure that when the tool 1 is in the first position no ridge is formed by the ends 68 of the second teeth 10, the first teeth 8 each comprise an abutment 69 so when the tool 1 is in the first position the first teeth 8 and the second teeth 10 combine to form a smooth surface up to the ends 70 of the first teeth 8.

In use the weaving tool 1 can be used to create hair tapestries as follows. In a first step the foot part 64 and the third part 41 are removed from the first end 4 and outer side 45 respectively of the first part 2.

The tool 1 is then used in the first position as a comb to gather a subject's hair 71 into strands, as shown in FIG. 6. The first comb portion 7 and the second comb portion 9 are aligned with one another and form a single comb structure for this action. The tool 1 is arranged with the outer side 45 of the first part 2 outermost. As the strands of the subject's hair 71 are gathered between the first teeth 8 and the second teeth 10, it is then manipulated down the first gasps 19 and the second gaps 29 therebetween and into the first cuts 20 of the first blocks of resilient material 18 and the second cuts 30 of the second blocks of resilient material 28, which are aligned with each other. This action can be performed by means of the user holding the strands of the subject's hair 71 which protrude from the tool 1 and forcing the tool 1 in a upwards direction, or by doing the opposite and holding the tool 1 stationary and pulling the strands of the subject's hair 71 which protrude from the tool 1 in a downwards direction. The user performs this action such that a sufficient length of the subject's hair 71 protrudes from the tool 1 to form warp strands when the tool is then moved into the second position, as shown in FIG. 7.

Figure 7:
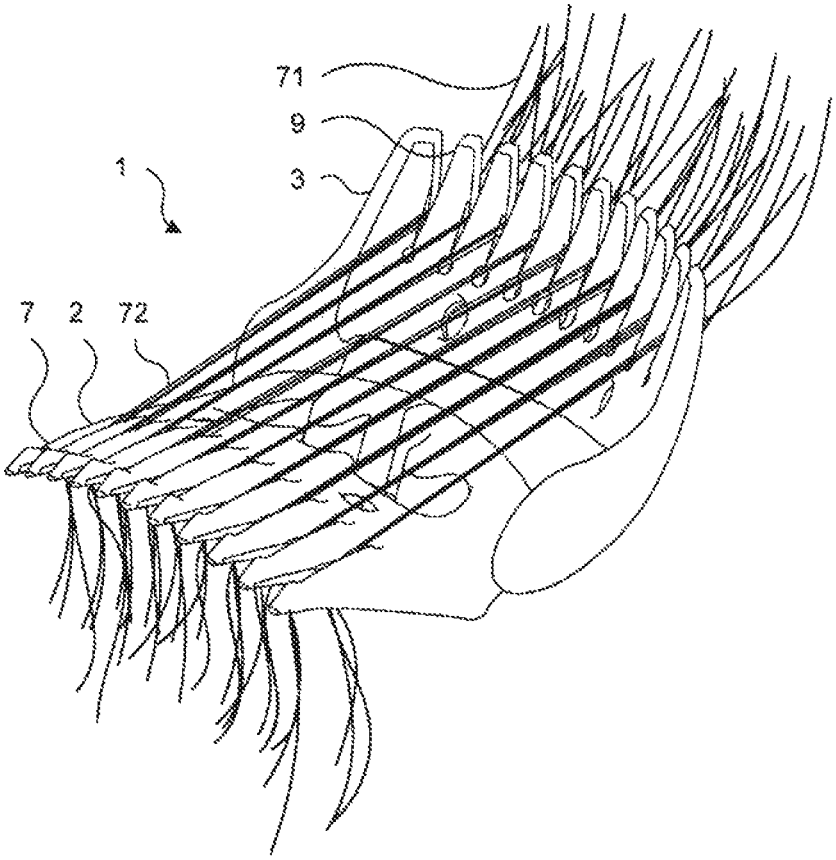
FIG. 7 is a perspective view of the weaving tool as shown in FIG. 1 in use in a second position.
Figure 8:
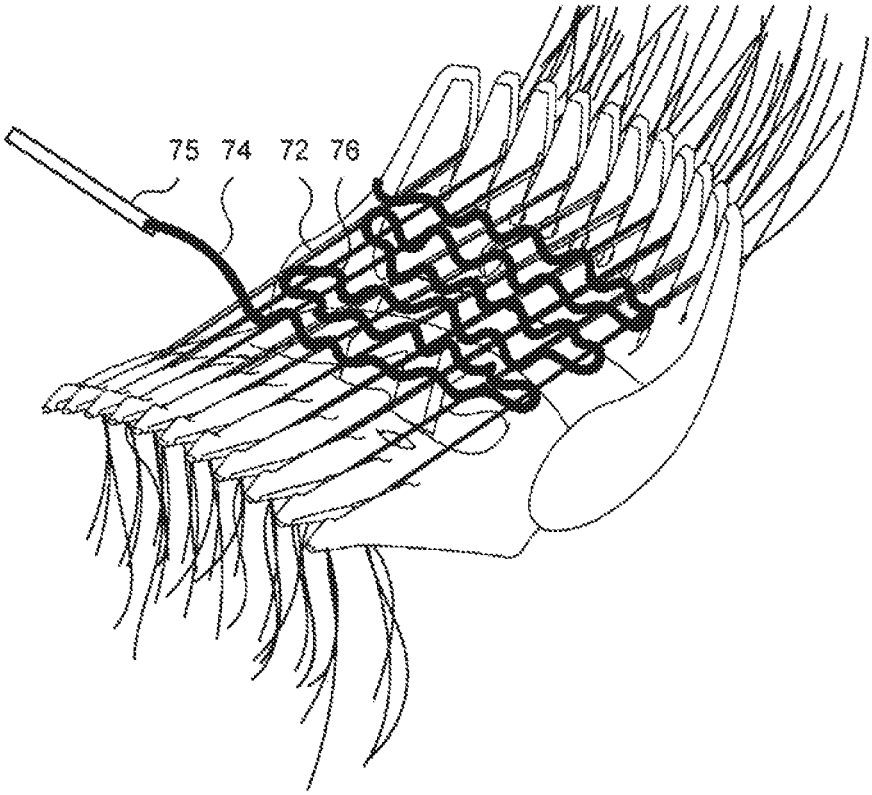
FIG. 8 is a perspective view of the weaving tool as shown in FIG. 1 in use in a second position.

Once the subject's hair has been captured in this way, the tool 1 is then manually moved into the second position, as shown in FIG. 7. When this action is carried out the first comb portion 7 travels down the strands of the subject's hair 71 into the position shown in FIG. 7, in which the strands of the subject's hair 71 are arranged as warp strands 72 between the first part 2 and the second part 3. The strands of the subject's hair 71 remain captured by the first comb portion 7 during this rotational movement from the fist to the second position due to it being held in the first cuts 20. Once the tool 1 reaches the second position the formed warp strands 72 are held taught between the first comb portion 7 and the second comb portion 9 because they are held in the first cuts 20 and the second cuts 30. It will be appreciated that the tension which is created will depend on the amount of the subject's hair 71 which is captured between each co-operating first and second cut 20 and 30, as well as the hair's density. However, it is not necessary for the tension of each warp strand 72 to be the same, or for the amount of hair to be equal. It is only necessary that warp strands 72 are formed with sufficient gaps between them to allow for the weaving process.

As the tool 1 is moved from the first position to the second position about the axis A-A of the hinge 6, the arms 37 and 38 rotate on the axis A-A in the slots (not visible) on the first part 2. This movement happens until the radial bosses 40 come into contact with the radial surfaces 39, which delimits further rotational movement. As is clear from the Figures, when this occurs the first comb portion 7 and the second comb portion 9 are normal to one another. As such, when the tool 1 is placed in the second position in use this ensures that the warp strands 72 are arranged at 45 degrees to the first part 2 and the second part 3, as is clear from FIG. 7. This provides the maximum amount of space in which to perform the weaving action by hand. A greater angle between the first part 2 and the second part 3 would reduce the space underneath the warp strands 72, and a lesser angle would reduce the length of the warp strands 72, thereby reducing the weavable area.

Referring to FIG. 5, when the tool 1 is placed in the second position, the outer side 73 of the second part 3, the second side walls 35 and 36, the first end 4 of the first part 2 and the outer side 45 of the first part 2 all combine to form an ergonomic shape which is suitable for holding in the palm of the hand, as shown. This makes the tool 1 comfortable for the user to hold with one hand, while they then perform the weaving action with the other.

Once the warp strands 72 have been formed, the user then weaves a thread of material 74 between the warp strands 72 using a needle 75. The material 74 thereby forms waft strands 76 to the warp strands 72. Once the user has manually woven the waft strands as desired, they can secure their ends by tying them off to the warp strands 72. The user can create a woven hair tapestry using one thread of material 74, or they can make one using multiple threads of material, one after the other.

Figure 10:
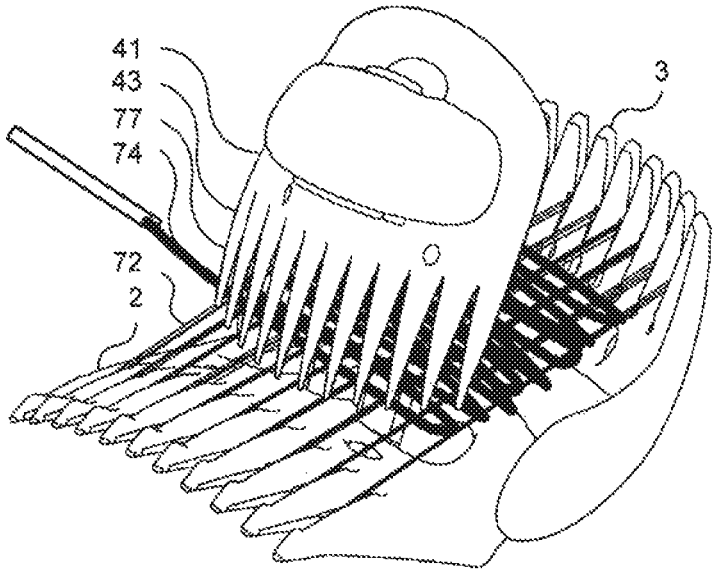
FIG. 10 is a perspective view of the weaving tool as shown in FIG. 1 in use in a second position.

Once a thread of material 74 has been woven the user can then use the third part 41 to compress it on the warp strands 72 by using the third comb portion 43 to drive it up the warp strands 72 by placing the third teeth 77 between the warp strands 72 and moving the third part 41 towards the second part 3, as shown in FIG. 10. This allows a user to weave one thread of material 74, move it into place adjacent the second part 3 (or the first part 2 if preferred), and then begin weaving another thread of material 74 in the remaining space.

Figure 9:
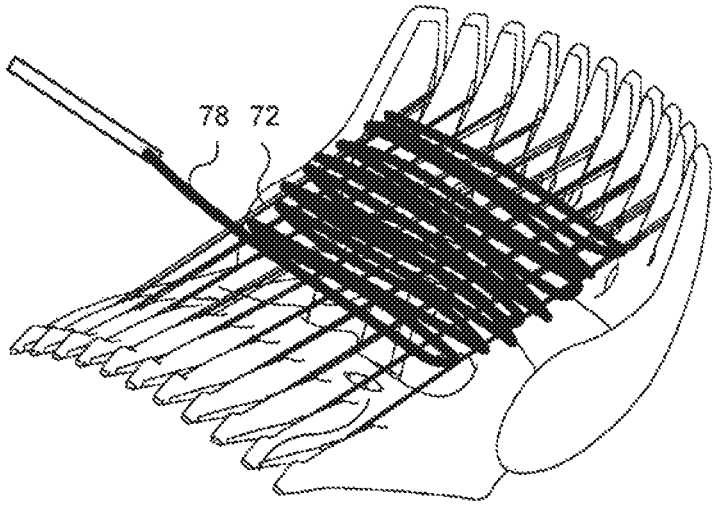
FIG. 9 is a perspective view of the weaving tool as shown in FIG. 1 in use in a second position.

As shown in FIG. 9 is it also possible for a user to create a hair tapestry by simply wrapping a thread of material 78 around the warp strands 72. This is an easier process and may be preferred by younger users.

Once the desired hair tapestry has been completed, the user can remove the tool 1 from the subject's hair by just drawing it away from the warp strands 72.

The tool 1 can then be rotated about the hinge 6 back into the first position, and placed on the foot part 64 for storage or display. The third part 41 can also be reattached to the first part 2.

It will be appreciated that as the tool 1 has a stylized character the user can also simply play with it in the manner of a toy character. In addition, the tool 1 can be used in the first position as a comb to simply comb a subject's hair in the known manner.

The weaving tool of the present invention can be altered without departing from the scope of claim 1. For example, in alternative embodiments (not shown) in the second position the first comb portion and the second comb portion are arranged at greater and lesser angles than 45 degrees. In other alternative embodiments (not shown) the resilient blocks of material are not used, and instead the first teeth and the second teeth have tapering gaps between them and a sufficient resilience to retain a subject's hair when placed under extension thereby.

In another alternative embodiment (not shown) the tool is aimed at adults, and does not comprise any stylized character features. Instead the first part and the second part comprise simple parts with linear surfaces.

Therefore, the present invention provides a collapsible loom like device which can be used to readily create hair tapestries in a much easier manner than when using two separate combs or a frame with clamps. In addition, a weaving tool is provided which is fun to use and to play with due to it comprising a stylized play character.

The invention claimed is:

1. A weaving tool comprising a first part and a second part, in which a first end of said first part is connected to a first end of said second part by a hinge, in which said hinge comprises a hinge axis, in which said first part comprises a first comb portion comprising a plurality of first teeth, in which each of said plurality of first teeth extends away from said hinge axis with a base part thereof proximal to said hinge axis and a tip part thereof distal to said hinge axis, and in which said second part comprises a second comb portion comprising a plurality of second teeth in which each of said plurality of second teeth extends away from said hinge axis with a base part thereof proximal to said hinge axis and a tip part thereof distal to said hinge axis, in which said first part and said second part are movable about said hinge axis between a first position in which said first comb portion and said second comb portion are substantially parallel and form a single comb structure comprising a plurality of composite teeth each one of which comprises one of said plurality of first teeth and one of said plurality of second teeth, and a second position in which said first comb portion and said second comb portion are displaced from one another about said hinge axis and a warp strand area for weaving is formed between the first part and the second part, in which said first comb portion comprises first blocks of resilient material in gaps between said first teeth, which first blocks of resilient material comprise cuts for receiving strands of warp material to be woven with which said tool is used, in which said cuts in said first blocks of resilient material comprises parallel opposed faces which are in contact with one another in a resting state.

2. A weaving tool as claimed in claim 1 in which said hinge comprises a stop mechanism which delimits rotation of said second part about said hinge beyond said second position, and in which in said second position said first comb portion and said second comb portion are substantially normal to one another.

3. A weaving tool as claimed in claim 1 in which said second comb portion comprises second blocks of resilient material in gaps between said second teeth, which second blocks of resilient material comprise cuts for receiving strands of warp material to be woven with which said tool is used.

4. A weaving tool as claimed in claim 1 in which said hinge comprises a pair of slots on said first part which are aligned with said axis and face outwardly from a centre point thereof in opposite directions, and a pair of arms on said second part, each of which faces towards said centre point and is disposed in one of said slots.

5. A weaving tool as claimed in claim 4 in which said slots are formed in first side walls of said first part, and in which said second part comprises second side walls overlaying said first side walls, from inside surfaces of which said arms extend.

6. A weaving tool as claimed in claim 3 in which said first part comprises a first outer member and a first inner member connected together, in which said first comb portion comprises a first outer comb portion provided on said first outer member and a first inner comb portion provided on said first inner member, in which said first outer comb portion comprises a first outer recess on an inner side thereof, and in which said first blocks of resilient material are disposed between said first outer member and said first inner member in a compartment formed by said first outer recess.

7. A weaving tool as claimed in claim 6 in which said second part comprises a second outer member and a second inner member connected together, in which said second comb portion comprises a second outer comb portion provided on said second outer member and a second inner comb portion provided on said second inner member, in which said second inner comb portion comprises a second inner recess on an outer side thereof, and in which said second blocks of resilient material are disposed between said second outer member and said second inner member in a compartment formed by said second inner recess.

8. A weaving tool as claimed in claim 1 in which an inner side of said first part comprises a stylized face comprising a mouth aperture and two eye formations.

9. A weaving tool as claimed in claim 8 in which each of said eye formations comprises an annular socket provided with an annular protrusion extending from a base thereof.

10. A weaving tool as claimed in claim 9 in which said mouth aperture comprises a complex shape with teeth abutments extending from an outer periphery thereof towards a centre point thereof.

11. A weaving tool as claimed in claim 10 in which said second part comprises a recess formed in said first end thereof, which recess exposes said mouth aperture in said first position, and in which said second part comprises two eye apertures which overlay said eye formations in said first position.

12. A weaving tool as claimed in claim 1 in which said first part comprises a foot part releasably connected to said first end thereof.

13. A weaving tool comprising a first part and a second part, in which a first end of said first part is connected to a first end of said second part by a hinge, in which said first part comprises a first comb portion with first teeth extending away from said hinge, and in which said second part comprises a second comb portion with second teeth extending away from said hinge, in which said first part and said second part are movable about an axis of said hinge between a first position in which said first comb portion and said second comb portion are substantially parallel, and a second position in which said first comb portion and said second comb portion are displaced from one another about said axis, in which said first comb portion comprises first blocks of resilient material in gaps between said first teeth, which first blocks of resilient material comprise cuts for receiving strands of warp material to be woven with which said tool is used, in which said second comb portion comprises second blocks of resilient material in gaps between said second teeth, which second blocks of resilient material comprise cuts for receiving strands of warp material to be woven with which said tool is used, in which said first part comprises a first outer member and a first inner member connected together, in which said first comb portion comprises a first outer comb portion provided on said first outer member and a first inner comb portion provided on said first inner member, in which said first outer comb portion comprises a first outer recess on an inner side thereof, and in which said first blocks of resilient material are disposed between said first outer member and said first inner member in a compartment formed by said first outer recess.

14. A weaving tool comprising a first part and a second part, in which a first end of said first part is connected to a first end of said second part by a hinge, in which said first part comprises a first comb portion with first teeth extending away from said hinge, and in which said second part comprises a second comb portion with second teeth extending away from said hinge, in which said first part and said second part are movable about an axis of said hinge between a first position in which said first comb portion and said second comb portion are substantially parallel, and a second position in which said first comb portion and said second comb portion are displaced from one another about said axis, in which an inner side of said first part comprises a stylized face comprising a mouth aperture and two eye formations, in which each of said eye formations comprises an annular socket provided with an annular protrusion extending from a base thereof, in which said mouth aperture comprises a complex shape with teeth abutments extending from an outer periphery thereof towards a centre point thereof, in which said second part comprises a recess formed in said first end thereof, which recess exposes said mouth aperture in said first position, and in which said second part comprises two eye apertures which overlay said eye formations in said first position.

* * * * *